United States Patent [19]

Stelling

[11] 4,058,078

[45] Nov. 15, 1977

[54] ANCHOR ASSEMBLY

[76] Inventor: William Stelling, 175 W. 72nd St., New York, N.Y. 10023

[21] Appl. No.: 676,040

[22] Filed: Apr. 12, 1976

[51] Int. Cl.[2] ..... B63B 21/24

[52] U.S. Cl. ..... 114/303; 114/304

[58] Field of Search ..... 114/208 R, 208 A, 206, 114/207, 294, 297, 298, 299, 301, 303, 304–310

[56] References Cited

U.S. PATENT DOCUMENTS

| | | | |
|---|---|---|---|
| 916,384 | 3/1909 | Baldt, Jr. | 114/208 R |
| 2,711,150 | 6/1955 | Ogg | 114/208 |
| 2,789,526 | 4/1957 | Gollner | 114/208 R |
| 3,045,633 | 7/1962 | Sarns | 114/208 R |
| 3,291,093 | 12/1966 | Wood, Jr. | 114/208 R |
| 3,306,248 | 2/1967 | Austin | 114/208 R |
| 3,712,259 | 1/1973 | Semolic | 114/207 |

*Primary Examiner*—Trygve M. Blix

*Assistant Examiner*—Jesus D. Sotelo

[57] ABSTRACT

An exchangeable anchor assembly comprising a free end adapted to be connected to a line, with two parallel crown plates disposed at opposite ends of the stem and sandwiching the stem therebetween. Carried between the crown plates are a pair of stop-limit elements to limit the extent of angular rotation of the stem between the stop-limit elements relative to the crown plates. A cross bar is provided for supporting the crown plates in a fixed position thereto and for carrying two or more combined fluke units having a sleeve connection. A stabilizer unit is provided which includes a pair of angularly displaced wing elements connected with each crown plate. Lock straps are provided to hold the entire unit on the cross bar and to permit relative movement of the stem about the cross bar with such movement limited by the stop-limit elements connected between the crown plates.

3 Claims, 4 Drawing Figures

ANCHOR ASSEMBLY

The present invention relates to an anchor assembly including removable and interchangable parts which can be easily taken apart by the user for storage and quick reassembly.

This invention is an improvement over the invention disclosed in applicant's co-pending application Ser. No. 605,790, now U.S. Pat. No. 3,964,420.

It is an object of the present invention to provide an improved anchor assembly which has removable interchangeable parts to be used for reassembly suited to varying bottom conditions.

A further object of the invention is the provision of an improved anchor assembly with a minimum number of interchangeable parts.

The present invention is an improvement over the earlier anchor assembly disclosed in the aforesaid co-pending application in that the present invention provides for a stabilizer and fluke units which can be easily assembled onto a crossbar and stored, the flukes being in a flat condition. For this purpose, the stabilizer unit includes two wing units which are connected with a crown plate and substantially perpendicular thereto. The wings are angularly displaced from each other approximately 60°. A sleeve is provided integrally connected with the fluke unit for placement onto a crossbar. In addition, the present invention proposes a simplified stop-limit member in the form of a pair of the crown plates which are positioned on opposite sides of a stem for supporting stop members or washers to limit the movement of the stem relative to the crossbar. The entire unit including the crown plate and the stop-limit members are disconnectable and can be stored in a substantially flat condition.

It will be obvious to those skilled in the art that a minimum number of parts are necessary in order to provide for a wide variety of anchor parts, while at the same time providing for a minimum storage area requirement.

Other objects and features of the present invention will become apparent from the following detailed description taken in connection with the accompanying drawing which discloses the preferred embodiment of the invention. It is to be understood, however, that the drawing is designed for the purpose of illustration only, and is not intended as a definition of the limits and scope of the invention disclosed.

In the drawing, wherein similar reference characters denote similar elements throughout the several views.

Figure 1:
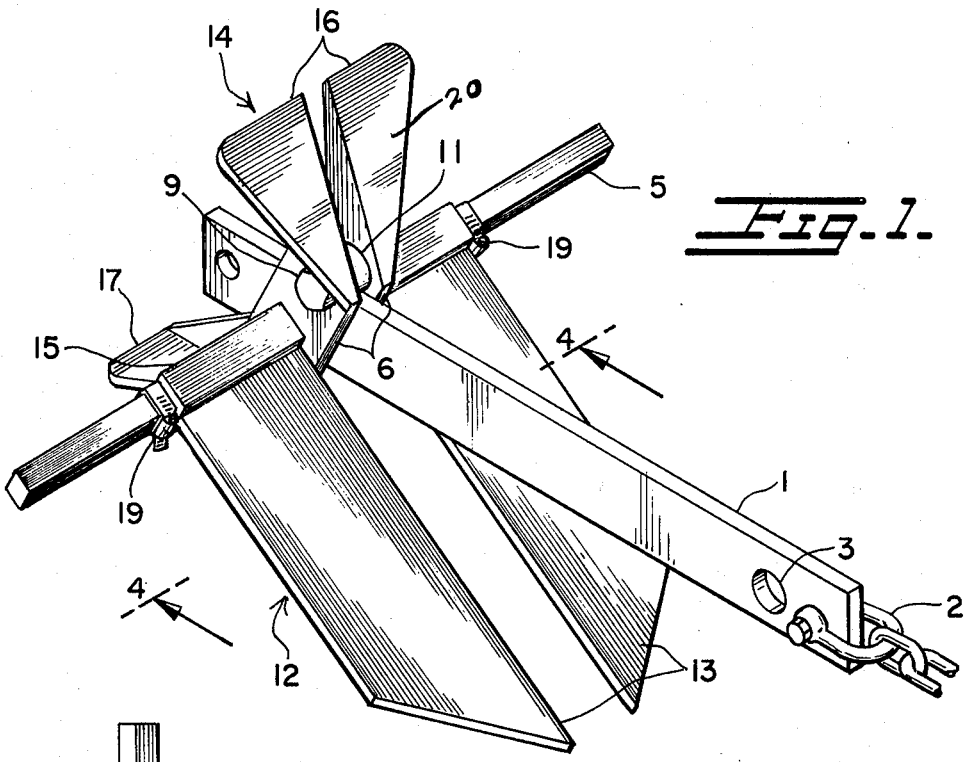
FIG. 1 is a perspective view of an interchangeable anchor system in accordance with the present invention.
Figure 2:
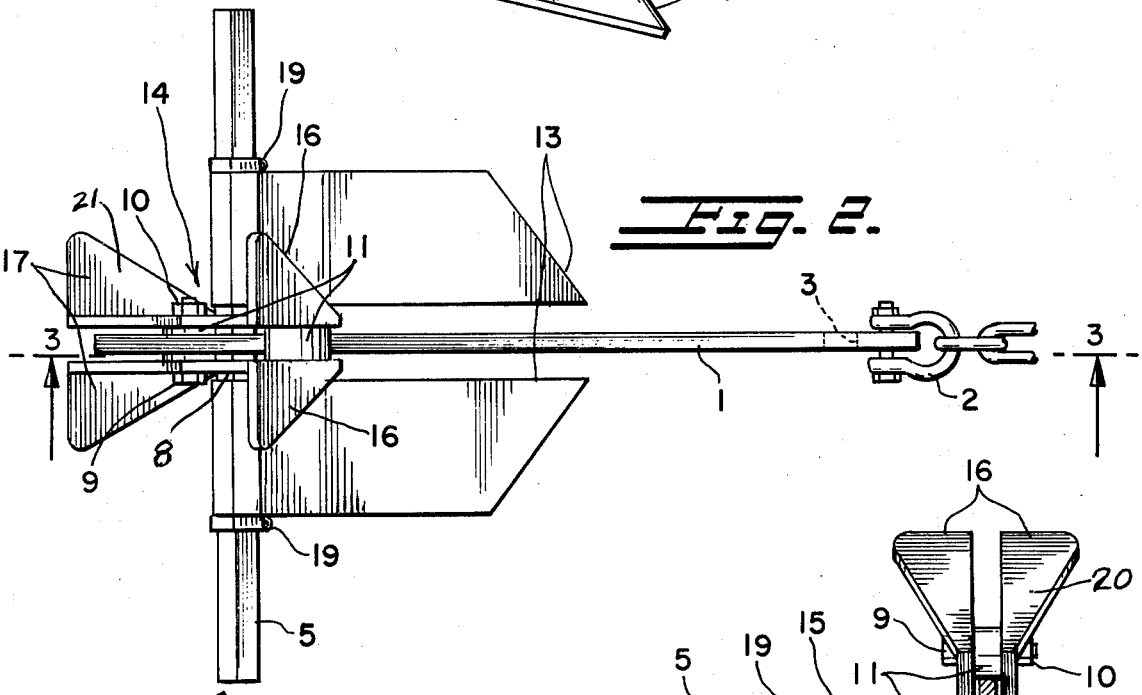
FIG. 2 is a top plan view of the assembly of FIG. 1.

In FIG. 1 of the drawing, the exchangeable anchor assembly in accordance with the invention comprises a stem or shank 1 of rectangular configuration provided at one end with a turnbuckle connection 2 for attachment to a line which holds the anchor to the ship. An opening 3 is also provided at the one end for connection of other stems to lengthen the length of the stem 1 where this is considered to be desirable.

Figure 3:
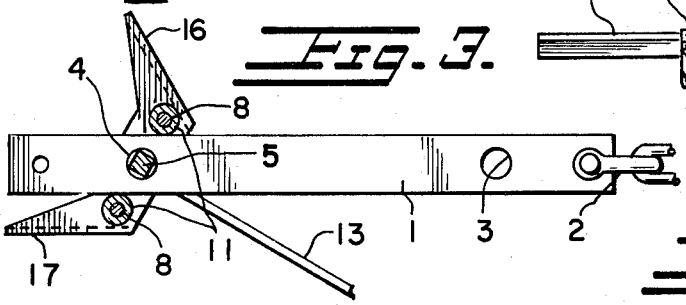
FIG. 3 is a section taken along the lines 3—3 of FIG. 2.
Figure 4:
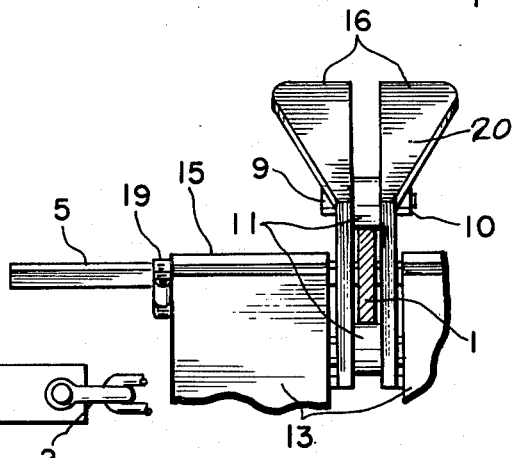
FIG. 4 is a partial section taken along the lines 4—4 of FIG. 1.

The other end of the stem is provided with a round opening 4 (FIG. 3) for receiving a crossbar 5 having either a square or a rectangular cross-section. Positioned on opposite sides of the stem 1 is a pair of crown plates 6, and each having an opening complementary to that of the crossbar 5 so that the crown plates may be threaded over the crossbar and rotate as a unit therewith. Each crown plate 6 also includes a pair of oppositely disposed openings 8 to receive a bolt 9 and nut 10 to form a bolt-nut assembly to carry a washer 11. Washer 11 is carried on bolt 9 between the crown plates 6. The pair of washers 11 form a stop-limit assembly to limit the rotation of the stem 1 on the crossbar 5. Each crossbar 5 also carries a fluke unit 12 and a stabilizer unit 14 on opposite sides of the washer 11. Stabilizer unit 14 is integrally connected with crown plate 6.

Each fluke unit 12 is provided with a fluke portion 13 connected to a sleeve 15 having an inner cross sectional opening complementary to that of the crossbar 5. Each stabilizer unit 14 is formed from two wing elements 16 and 17, angularly displaced from each other and connected with crown plate 6. Wing elements 16 and 17 of each stabilizer portion 14 have a face portion 20, 21 respectively which lie in planes angularly displaced from each other approximately 60°. Crown plate 6 lies in a plane perpendicular to the planes of face portions 20, 21. Lock straps 19 are provided at opposite ends of the crossbar 5 adjacent to the sleeve 15 to lock the stabilizer-fluke units 12 together with the crown plate 6 onto the crossbar 5.

It will be evident that it is possible for the crown plate 6 to be assembled with different washers 11 by means of the bolt-nut assembly 9–10, and then have the cross bar, crown plates, and stem 1 assembled together by passing the cross bar through the openings 4 and 8. After assembly of the crown plates 6 with the stem 1, one or more fluke units 12 are placed on opposite sides of the crown plates. It should be noted that it is possible to use more than one pair of fluke units 12 on each side of the crown plates, and for this purpose, the crossbar 5 may also be made in various lengths. After the desired number of fluke units 12 are placed onto the crossbar 5 by placing the sleeves 15 thereover, the straps 19 are placed on opposite sides of the sleeve 15 for locking the fluke units against the crown plates 6 whereby to secure the entire unit.

Depending upon the extent of the camming action required or the amount of pivotal movement desired to be imparted to shaft 1 will determine the size of the washers 11 which act as stop-limit elements to limit the rotation of the stem therebetween. It should be also noted that different size washers may be used.

It will be apparent to those skilled in the art that when it is desired to change the anchor design for a different condition, all that is necessary is to open the lock straps 19, and change fluke units 12, stabilizer units 14, and/or the stop-limit devices 11.

While only a few embodiments of the present invention have been shown and described, it will be obvious to those skilled in the art that many chages and modifications may be made thereunto without departing from the spirit and scope of the invention.

What is claimed is:

1. An exchangeable anchor assembly, including removable and interchangeable parts which can be easily taken apart by the user for storage and quick reassembly, said anchor assembly comprising:

a stem having a free end adapted to be connected to a line and an opposite end having a round opening;

a cross bar having an unround cross-section received in said opening of said stem, said cross bar being rotatably disposed with respect to and perpendicular to said stem;

a pair of removable crown plates disposed at said opposite end of said stem on opposite sides thereof, said crown plates having an opening the dimensions of which are substantially equal to that of said cross bar and being slidable on said cross bar from opposite ends thereof, said plates being removably connectable with said cross bar;

a set of stop-limit members removably connected between said crown plates; such that said opposite end of said stem is rotatably connected to said cross bar between said stop-limit members, said stop-limit members cooperating with said stem, permitting relative rotatable movement of said cross bar when said stop-limit members abut said stem;

a stabilizer unit, including two wing elements, integrally connected with each of said crown plates, said wing elements lying in planes angularly displaced from each other approximately 60°;

at least two removable fluke units, including a sleeve having an opening the dimensions of which are substantially equal to that of said cross bar and disposed on the ends thereof, each of said fluke units including a fluke portion connected to its said respective sleeve, said sleeve permitting said fluke units to be removed from said cross bar; and means for removably securing said at least two fluke units onto said cross bar and holding said units against said crown plates for conjoint movement therewith, and for permitting removal of said sleeve from said cross bar whereby to remove said fluke units therewith.

2. The assembly as recited in claim 1, wherein each of said stop-limit members including a bolt-nut assembly, said bolt-nut assembly including a bolt having a shank portion positioned between said crown plates, an interchangeable collar carried on said shank portion and held between said crown plates.

3. The assembly as recited in claim 1, said crown plates lying in a plane substantially perpendicular to the planes of said wing elements.

* * * * *